US012698136B2

(12) United States Patent
Pinelli et al.

(10) Patent No.: US 12,698,136 B2
(45) Date of Patent: Aug. 4, 2026

(54) LID SEAL MECHANISM

(71) Applicant: Leapfrog Product Development LLC, Chicago, IL (US)

(72) Inventors: Steven N. Pinelli, Chicago, IL (US); Micaela K. McCabe, Chicago, IL (US)

(73) Assignee: Leapfrog Product Development LLC, Chicago, IL (US)

( * ) Notice: Subject to any disclaimer, the term of this patent is extended or adjusted under 35 U.S.C. 154(b) by 18 days.

(21) Appl. No.: 18/783,744

(22) Filed: Jul. 25, 2024

(65) Prior Publication Data

US 2025/0033845 A1 Jan. 30, 2025

Related U.S. Application Data

(60) Provisional application No. 63/515,443, filed on Jul. 25, 2023.

(51) Int. Cl.

| | |
|---|---|
| ***B65D 47/28*** | (2006.01) |
| ***A47G 19/22*** | (2006.01) |
| ***B65D 43/02*** | (2006.01) |
| ***B65D 47/32*** | (2006.01) |
| ***B65D 53/02*** | (2006.01) |

(52) U.S. Cl.

CPC ..... *B65D 47/286* (2013.01); *A47G 19/2272* (2013.01); *B65D 43/0229* (2013.01); *B65D 47/32* (2013.01); *B65D 53/02* (2013.01); *B65D 2543/00046* (2013.01); *B65D 2543/00092* (2013.01); *B65D 2543/0049* (2013.01); *B65D 2543/00972* (2013.01)

(58) Field of Classification Search

CPC .. B65D 47/286; B65D 47/32; B65D 43/0229; B65D 43/0225; B65D 53/02; B65D 2543/00046; B65D 2543/00092; B65D 2543/0049; B65D 2543/00972; A47G 19/2272

USPC .... 220/254.9, 254.1, 259.5, 259.1, 812, 811, 220/810, 345.6, 345.4, 348, 345.1, 715, 220/714, 711

See application file for complete search history.

(56) References Cited

U.S. PATENT DOCUMENTS

| | | | | |
|---|---|---|---|---|
| 4,212,408 | A | 7/1980 | Valenzona | |
| 2003/0089714 | A1 | 5/2003 | Dart et al. | |
| 2003/0136783 | A1 | 7/2003 | Hatsumoto et al. | |
| 2015/0060448 | A1* | 3/2015 | Coon | B65D 43/0225 220/254.1 |

(Continued)

OTHER PUBLICATIONS

International Search Report and Written Opinion for PCT/US2024/39489 dated Nov. 6, 2024 (11 pages).

*Primary Examiner* — Robert J Hicks

(74) *Attorney, Agent, or Firm* — Barnes & Thornburg LLP

(57) ABSTRACT

A lid seal mechanism for sealing a drink opening in a lid of a beverage container. The lid seal mechanism has a slider, a plunger and a plunger seal. The slider body slides between a closed position and an open position, and pivots to a cleaning position. The slider body is connected to the lid in each of the closed, open, and cleaning positions. The slider has a body with a front and a rear. The plunger is pivotally connected to the front of the slider. The plunger seal is connected to the plunger. The plunger seal seals the drink opening in the lid when the slider is in the closed position, and the plunger seal opens the drink opening when the slider is in the open position to allow a user to drink contents from the beverage container.

20 Claims, 7 Drawing Sheets

(56) References Cited

U.S. PATENT DOCUMENTS

| | | | | |
|---|---|---|---|---|
| 2015/0201776 | A1* | 7/2015 | Elsaden | A47G 19/2272 220/715 |
| 2017/0297785 | A1 | 10/2017 | Maruyama et al. | |
| 2018/0244441 | A1 | 8/2018 | Wodka | |
| 2020/0377272 | A1 | 12/2020 | Ma et al. | |
| 2020/0391910 | A1 | 12/2020 | Pinelli et al. | |
| 2022/0112011 | A1* | 4/2022 | McNamara | B65D 51/18 |

* cited by examiner

LID SEAL MECHANISM

CROSS-REFERENCE TO RELATED APPLICATIONS

This application claims the benefit of U.S. Provisional Patent Application No. 63/515,443 filed Jul. 25, 2023, which is expressly incorporated herein by reference and made a part hereof.

FEDERALLY SPONSORED RESEARCH OR DEVELOPMENT

Not Applicable.

TECHNICAL FIELD

The present subject matter relates to a lid seal mechanism for a container, and more particularly, to a lid seal mechanism for a lid that automatically seals upon sliding a closure.

BACKGROUND

Beverage containers are known in the art. While such products according to the prior art provide a number of advantages, they nevertheless have certain limitations, especially when combined together. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology relates to lids for beverage containers that have quick-fill functionality.

The disclosed technology further relates to a lid seal mechanism for sealing a drink opening in a lid of a beverage container, comprising: a slider having a body with a front and a rear, a front flange extending outwardly adjacent a front of the body, and a rear flange extending outwardly adjacent a rear of the body; a plunger pivotally connected to the front of the slider with a plunger pin; a plunger seal connected to a first end of the plunger, wherein the plunger pivots between a first position and a second position, in the first position the plunger is away from the drink opening, and in the second position the plunger is aligned with the drink opening such that the plunger seal can seal the drink opening; and, wherein the lid has a cavity with a first end and a second end, wherein the drink opening is in the cavity toward a first end thereof, wherein the cavity has tracks that receive the front flange and rear flange of the slider body to allow the slider to slide within the tracks between a closed position and an open position, and to a cleaning position, wherein the plunger is in the first position when the slider body is in the open position, and wherein the plunger is in the second position when the slider body is in the closed position.

The disclosed technology further relates to a lid seal mechanism for sealing a drink opening in a lid of a beverage container, comprising: a slider on a top surface of the lid, the slider body having a body with a front and a rear, a front flange extending outwardly adjacent a front of the body, and a rear flange extending outwardly adjacent a rear of the body; a plunger pivotally connected to the front of the slider with a plunger pin; and, a plunger seal connected to a first end of the plunger, wherein the plunger pivots between a first position and a second position, in the first position the plunger is away from the drink opening to allow a user to drink contents from the beverage container, and in the second position the plunger is aligned with the drink opening such that the plunger seal seals the drink opening.

The disclosed technology further relates to a lid seal mechanism for sealing a drink opening in a lid of a beverage container, comprising: a slider having a body with a front and a rear, the slider body sliding between a closed position and an open position, and pivoting to a cleaning position, the slider being connected to the lid in each of the closed position, open position, and cleaning position; a plunger connected to the front of the slider; and, a plunger seal connected to the plunger, the plunger seal sealing the drink opening in the lid when the slider is in the closed position, and the plunger seal opening the drink opening when the slider is in the open position.

The disclosed technology further relates to a lid seal mechanism for sealing a drink opening in a lid of a beverage container, wherein the cavity has deeper portions at the first end and second end thereof.

The disclosed technology further relates to a lid seal mechanism for sealing a drink opening in a lid of a beverage container, wherein the slider body has two front flanges and two rear flanges.

The disclosed technology further relates to a lid seal mechanism for sealing a drink opening in a lid of a beverage container, wherein the rear flanges extend outwardly further than the front flanges.

The disclosed technology further relates to a lid seal mechanism for sealing a drink opening in a lid of a beverage container, wherein the plunger has a cam follower that extends from the plunger toward the lid and which assists in pivoting the plunger toward the drink opening when the slider is pushed toward the drink opening of the lid by a user.

The disclosed technology further relates to a lid seal mechanism for sealing a drink opening in a lid of a beverage container, wherein a bottom wall of the cavity has a cam surface that engages the cam follower of the plunger to pivot the plunger from its first position to its second position.

The disclosed technology further relates to a lid seal mechanism for sealing a drink opening in a lid of a beverage container, wherein the cavity has an exit opening between the first end and the second end of the cavity to allow the front flange to exit out of the cavity when the slider is pivoted to the cleaning position.

The disclosed technology further relates to a lid seal mechanism for sealing a drink opening in a lid of a beverage container, wherein the lid has a vent opening, and wherein the slider body has a closure member that closes the vent opening when the slider body is in the closed position.

The disclosed technology further relates to a lid seal mechanism for sealing a drink opening in a lid of a beverage container, wherein the slider body is connected to the lid in the closed position, open position, and cleaning position.

The disclosed technology further relates to a lid seal mechanism for sealing a drink opening in a lid of a beverage container, wherein upon sliding the slider body from the open position to the closed position a seal on the plunger automatically seals the drink opening in the lid, and wherein on sliding the slider body from the closed position to the open position the seal on the plunger automatically opens the drink opening in the lid so the user can drink contents within the beverage container.

The disclosed technology further relates to a lid seal mechanism for sealing a drink opening in a lid of a beverage container, wherein the lid has a cavity with a first end and a second end, wherein the drink opening is in the cavity toward a first end thereof, wherein the cavity has tracks that receive the front flange and rear flange of the slider body to allow the slider to slide within the tracks between a closed position, an open position, and a cleaning position, wherein the plunger is in the first position when the slider body is in the open position, and wherein the plunger is in the second position when the slider body is in the closed position.

The disclosed technology further relates to a lid seal mechanism for sealing a drink opening in a lid of a beverage container, wherein the plunger has a cam follower that extends from the plunger toward the lid and which assists in pivoting the plunger toward the drink opening when the slider is pushed toward the drink opening of the lid by a user, wherein the lid has a cavity having a bottom wall, and wherein the bottom wall has a cam surface that engages the cam follower of the plunger to pivot the plunger from its first position to its second position.

The disclosed technology further relates to a lid seal mechanism for sealing a drink opening in a lid of a beverage container, wherein the lid has a top surface, and wherein the slider is positioned adjacent the top surface of the lid.

The disclosed technology further relates to a lid seal mechanism for sealing a drink opening in a lid of a beverage container, wherein the plunger has a first end and a second end, the second end of the plunger being pivotally connected to the front of the slider with a pin.

The disclosed technology further relates to a lid seal mechanism for sealing a drink opening in a lid of a beverage container, wherein the plunger seal is connected to the first end of the plunger, wherein the plunger pivots between a first position and a second position, wherein upon sliding the slider body from the open position to the closed position the plunger seal seals the drink opening in the lid, wherein on sliding the slider body from the closed position to the open position the plunger seal opens the drink opening in the lid so the user can drink contents within the beverage container, and wherein upon moving the slider body to the cleaning position the slider body is pivoted away from the lid.

The disclosed technology further relates to a lid seal mechanism for sealing a drink opening in a lid of a beverage container, wherein the lid has a cavity with a first end and a second end, wherein the drink opening is in the cavity toward a first end thereof, wherein the cavity has tracks that receive flanges extending from the slider body to allow the slider to slide within the tracks between the closed position and the open position.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings.

Figure 1:
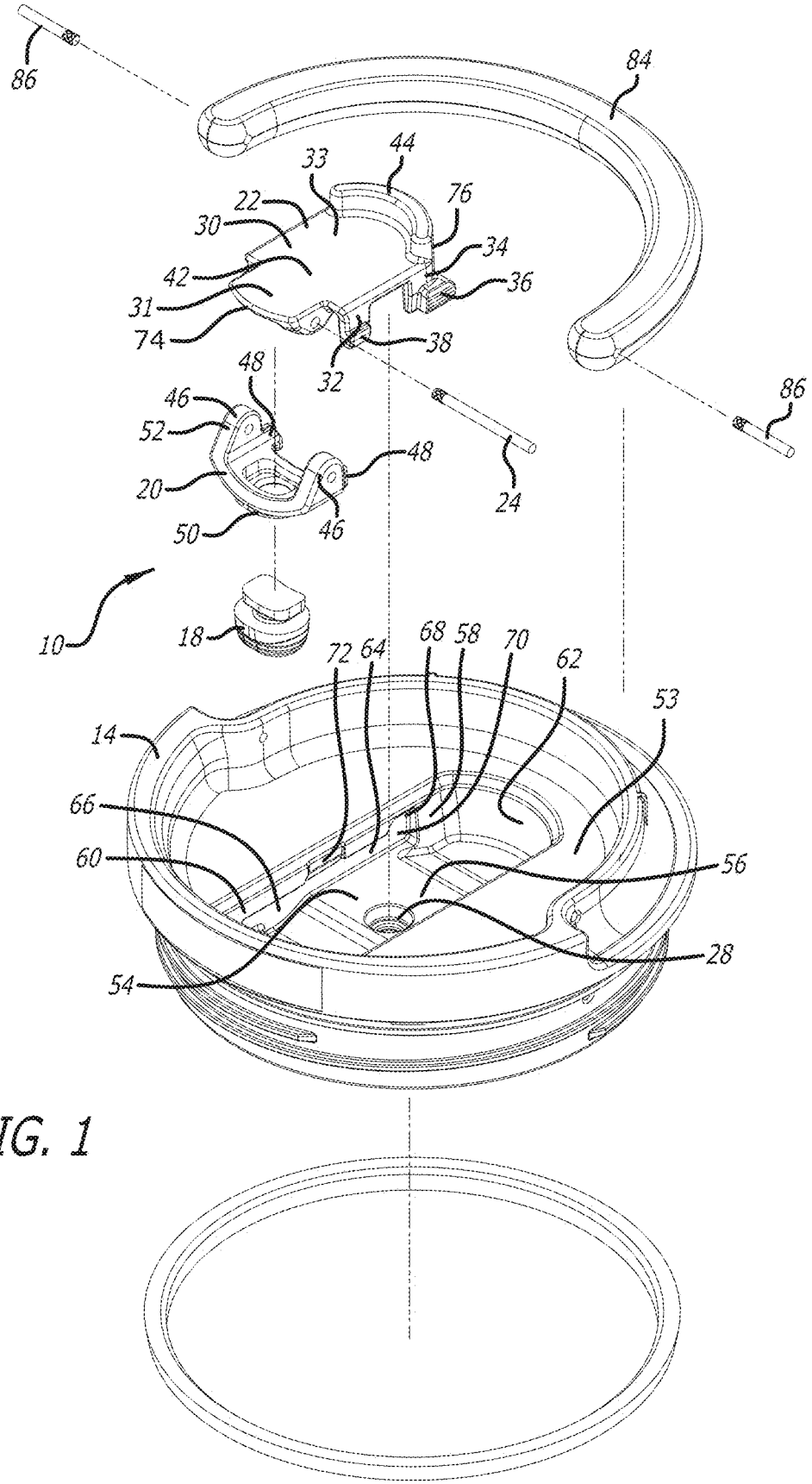
FIG. 1 is an exploded view of a lid seal mechanism for a beverage container lid, according to the present disclosure.
Figure 2:
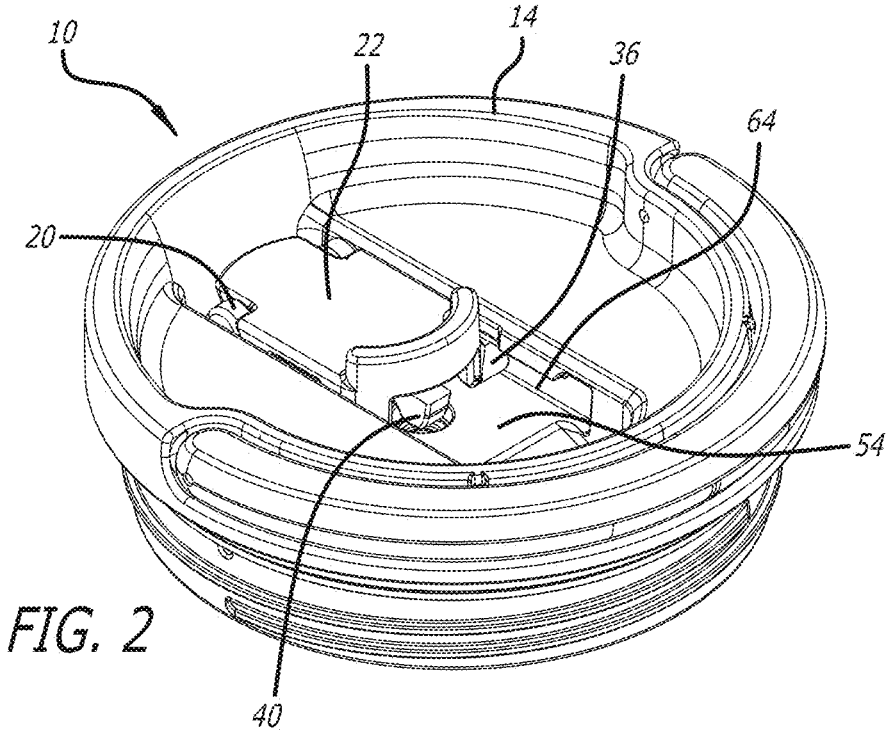
FIG. 2 is a front top perspective view of a lid with a lid seal mechanism in the open position, according to the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible of embodiments in many different forms, there is shown in the drawings and will herein be described in detail preferred embodiments with the understanding that the present disclosure is to be considered as an exemplification of the principles of the disclosure and is not intended to limit the broad aspect of the disclosure to the embodiments illustrated. It should be noted that the features illustrated in the drawings are not necessarily drawn to scale, and features of one embodiment may be employed with other embodiments as one of ordinary skill in the relevant art would recognize, even if not explicitly stated herein. Further, descriptions of well-known components and processing techniques may be omitted so as to not unnecessarily obscure the embodiments of the present disclosure. The examples used herein are intended merely to facilitate an understanding of ways in which the present disclosure may be practiced and to further enable those of ordinary skill in the art to practice the embodiments of the present disclosure. Accordingly, the examples and embodiments herein should not be construed as limiting the scope of the present disclosure, which is defined solely by the appended claims and applicable law.

Figure 6:
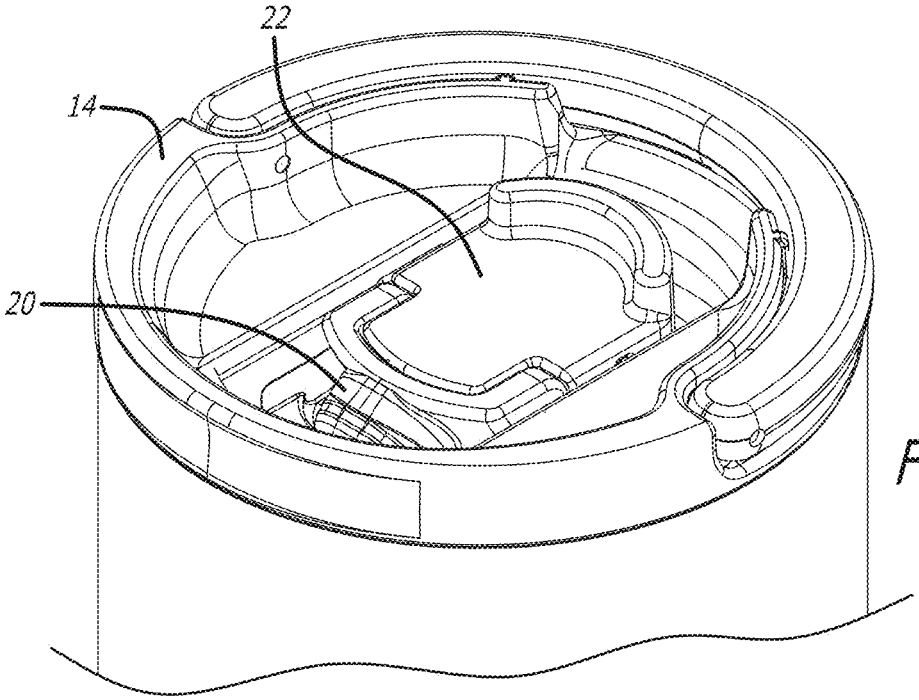
FIG. 6 is a front top perspective view of a lid with a lid seal mechanism in the open position, according to the present disclosure.
Figure 7:
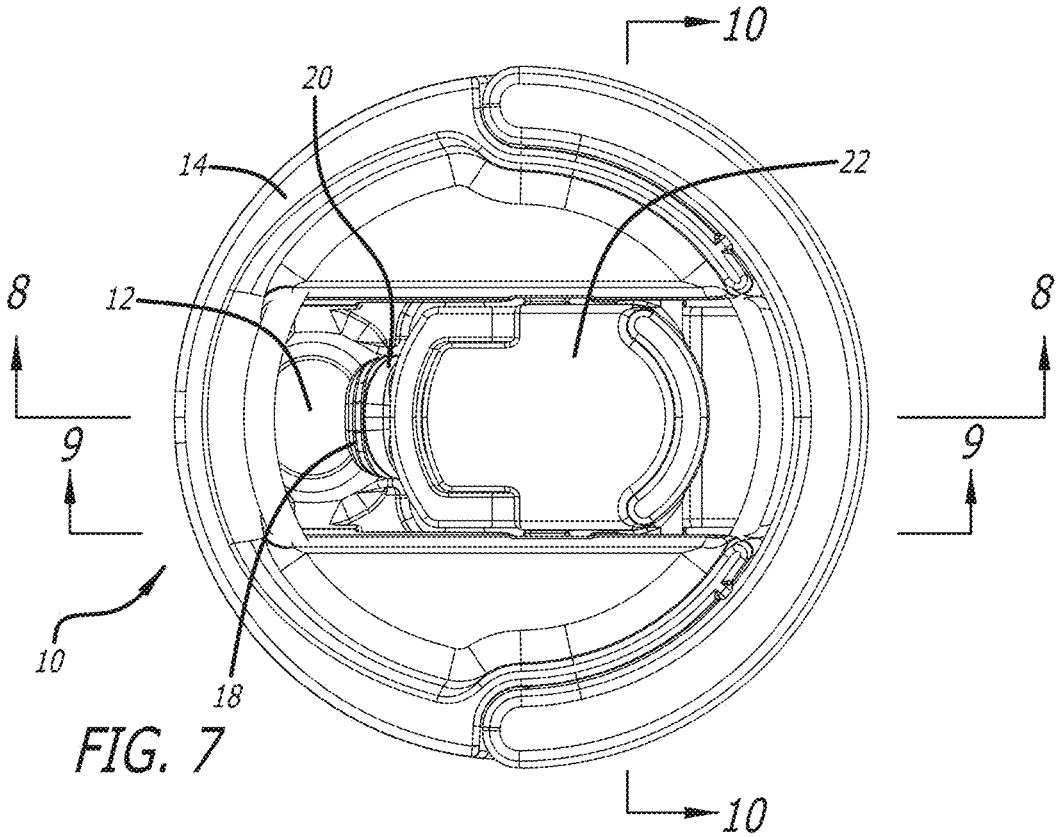
FIG. 7 is top plan view of the lid of FIG. 6, according to the present disclosure.
Figure 11:
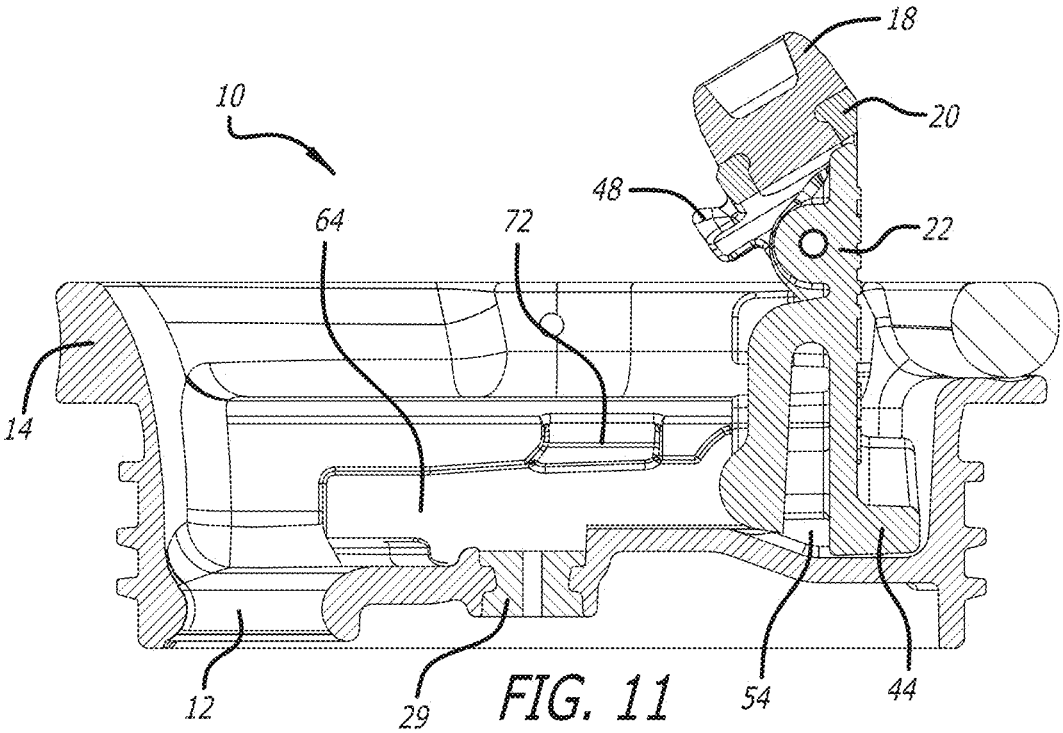
FIG. 11 is a cross-sectional view of the lid of FIG. 7, about line 8-8, with the lid seal mechanism in the cleaning position, according to the present disclosure.
Figure 12:
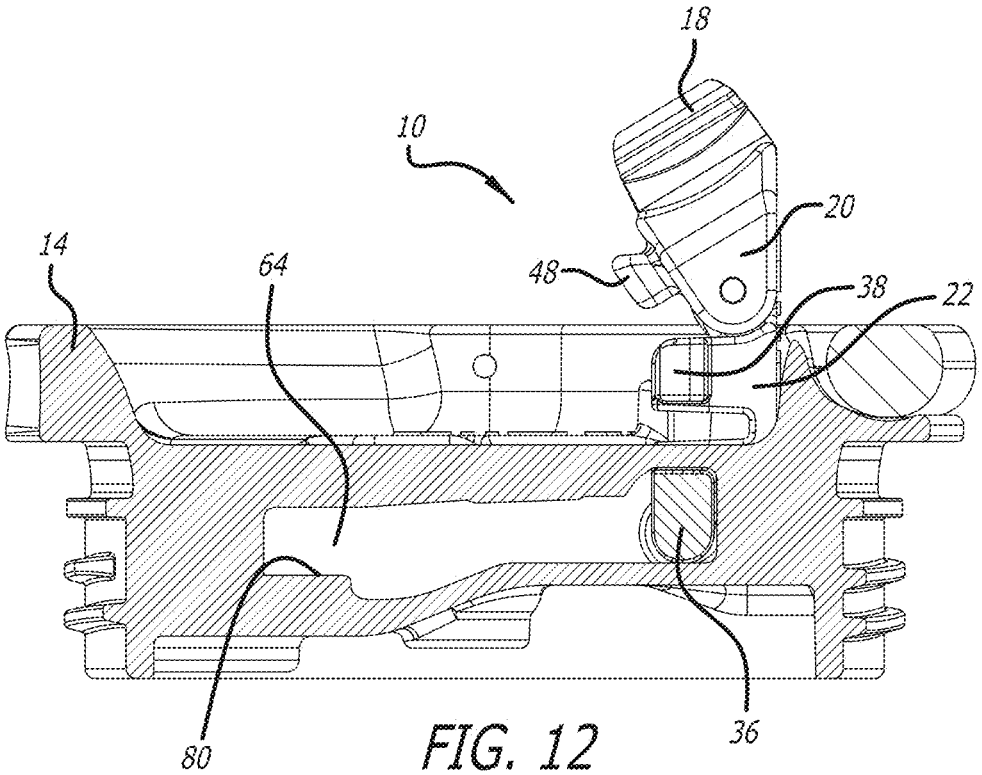
FIG. 12 is a cross-sectional view of the lid of FIG. 7, about line 9-9, with the lid seal mechanism in the cleaning position, according to the present disclosure.

Generally, this disclosure describes several embodiments of a lid seal mechanism 10 for sealing a drink opening 12 in a lid 14 of a beverage container 16. The lid seal mechanism 10 is moveable between a closed position (FIGS. 1-5), an open position (FIGS. 6-8), and a cleaning position (FIGS. 11 and 12). In each position the lid seal mechanism 10, and therefore the slider 22, is connected to the lid 14. Upon sliding the lid seal mechanism 10 from the open position to the closed position, the seal 18 on the plunger 20 automatically seals the drink opening 12 in the lid 14. And, on sliding the lid seal mechanism 10 from the closed position to the open position, the seal 18 on the plunger 20 automatically opens the drink opening 12 in the lid 14 so the user can drink the contents within the beverage container 16.

Figure 13:
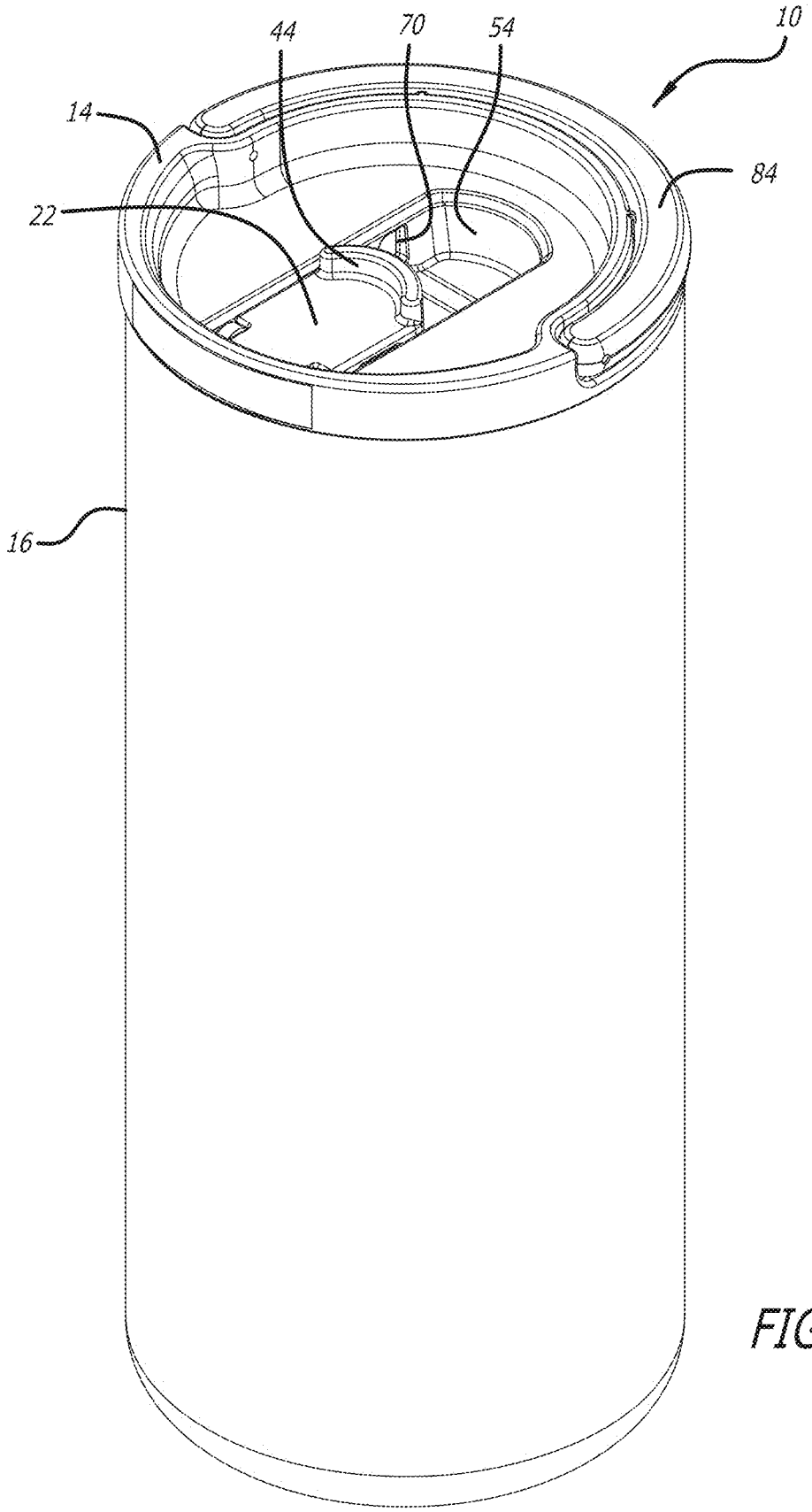
FIG. 13 is a front top perspective view of a beverage container having a lid with a lid seal mechanism in the closed position, according to the present disclosure.

Referring now to the figures, and initially to FIGS. 1 and 13, there is shown a lid seal mechanism 10 for sealing a drink opening 12 in a lid 14 of a beverage container 16. In one embodiment, the lid seal mechanism 10 comprises a slider 22, a plunger 20, a plunger pin 24, and a plunger seal 18. The lid seal mechanism 10 operates in connection with a lid 14 of a beverage container 16. In one embodiment, in addition to the drink opening 12, the lid 14 also has a vent opening 28 with a vent grommet 29.

In one embodiment the slider 22 is slidingly connected to the lid 14 adjacent a top surface 53 of the lid 14. The slider 22 has a body 30 with a front 31, two front legs 32 adjacent the front 31 of the body 30, a rear 33, and two rear legs 34 adjacent the rear 33 of the body 30. Each rear leg 34 has an outwardly extending rear flange 36, and each front leg 32 has an outwardly extending front flange 38. In one embodiment, the flanges 36 of the rear legs 34 extend further out than the flanges 38 of the front legs 32. Further, the slider 22 has a closure member 40 for the vent opening 28. The body 30 of the slider 22 also has a top surface 42 and a rear shoulder 44 that can be engaged by the user to move the slider 22 back and forth on the lid 14 and also to move the slider 22 to the cleaning position.

Figure 5:
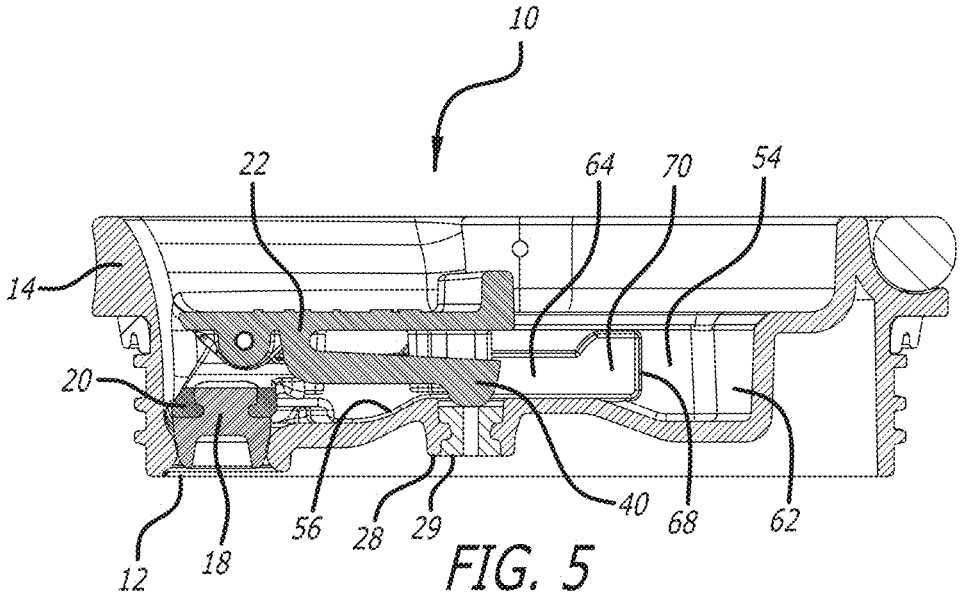
FIG. 5 is a cross-sectional view of the lid of FIG. 4 about line 5-5, according to the present disclosure.
Figure 8:
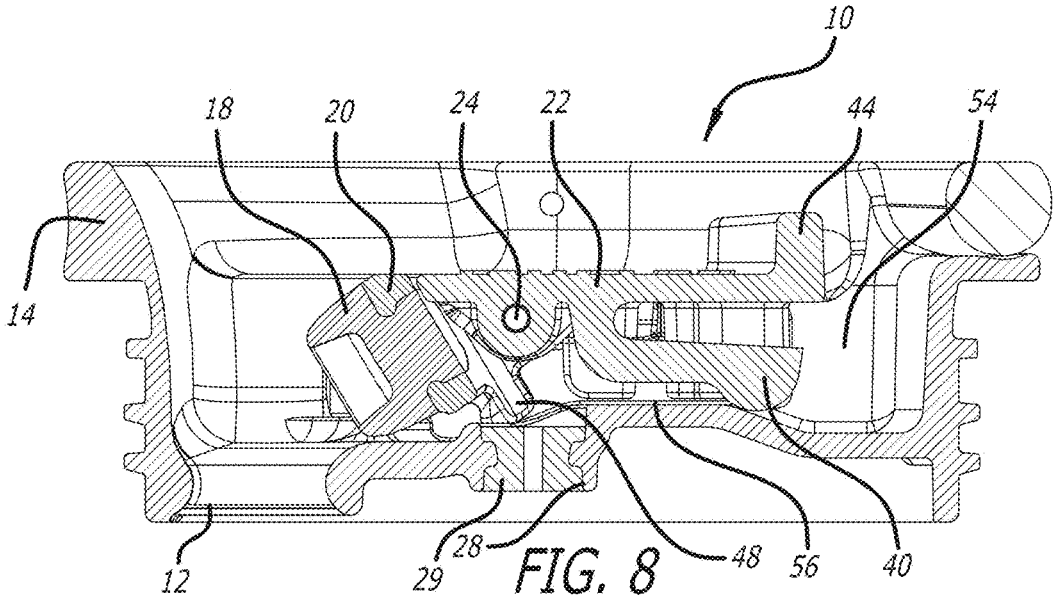
FIG. 8 is a cross-sectional view of the lid of FIG. 7, about line 8-8, according to the present disclosure.
Figure 9:
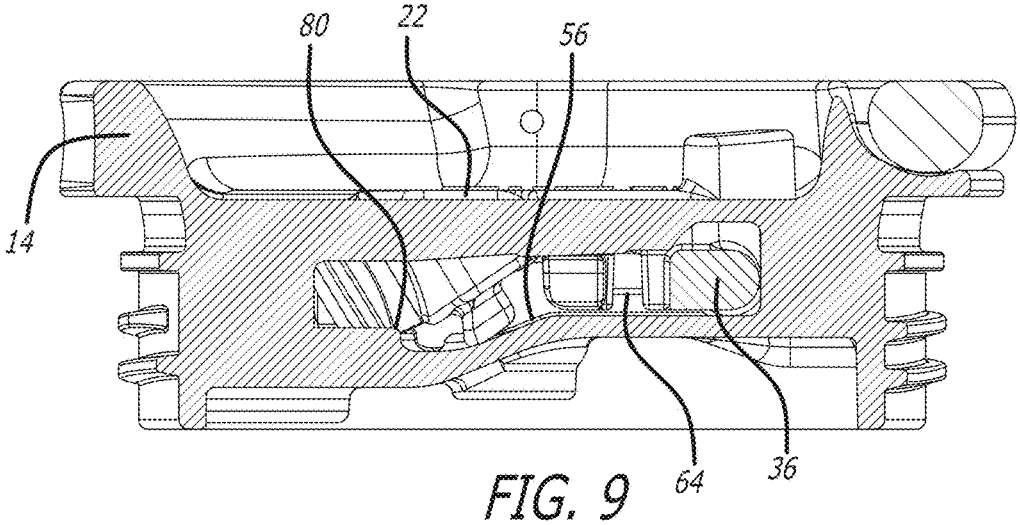
FIG. 9 is a cross-sectional view of the lid of FIG. 7, about line 9-9, according to the present disclosure.

In one embodiment, as shown in FIGS. 1, 5 and 8, the plunger 20 is pivotally connected to the front 31 of the body 30 of the slider 22 with the plunger pin 24, and therefore the plunger 20 pivots with respect to the slider body 30 about the plunger pin 24. The plunger pin 24 extends through first and second cars 46 of the plunger 20, and also to the slider body 30, to pivotally connect the plunger 20 to the slider 22. In one embodiment, the plunger 20 also has cam followers 48 that extend from the plunger 20 toward the lid 14 and which assist in pivoting the plunger 20 when the slider 22 is pushed toward the drink opening 12 of the lid 14 by a user.

The plunger seal 18 is used to close the drink opening 12. The plunger seal 18 is connected to the plunger 20 at the first end 50 of the plunger 20, whereas the cars 46 of the plunger 20 are generally located toward the second end 52 of the plunger 20. As shown in the figures, the plunger 20 pivots between a first position (FIG. 8) and a second position (FIG. 5). In the first position the plunger 20 is angled away from the drink opening 12, and in the second position the plunger 20 is aligned with the drink opening 12 such that the seal 18 on the first end 50 of the plunger 20 can be inserted into the drink opening 12 to seal the drink opening 12. In one embodiment, a longitudinal axis of the seal 18 is aligned with a longitudinal axis of the drink opening 12 when the slider 22 is in the closed position and the plunger 20 is in its second position.

Figure 3:
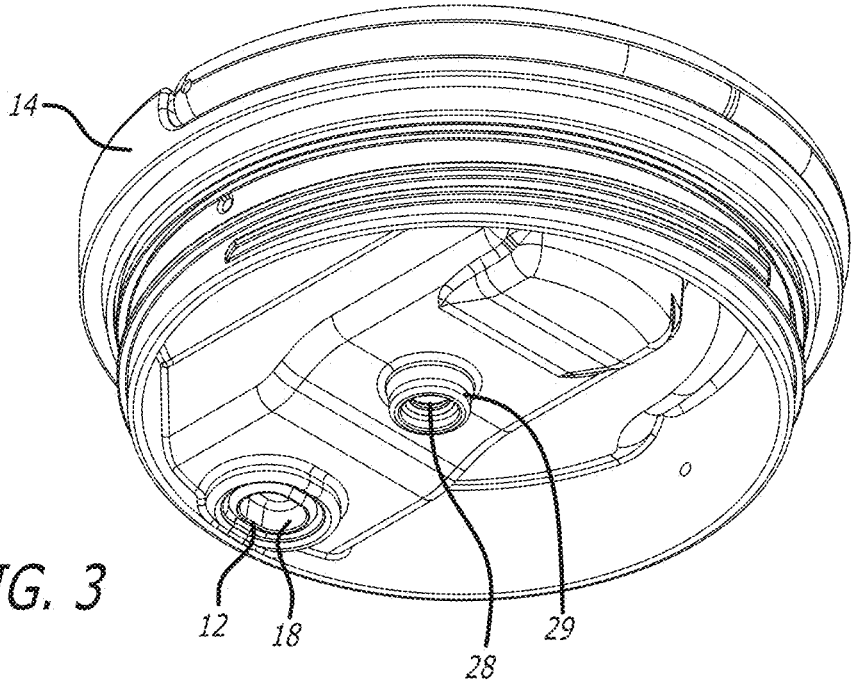
FIG. 3 is a rear bottom perspective view of a lid with a lid seal mechanism in the closed position, according to the present disclosure.
Figure 4:
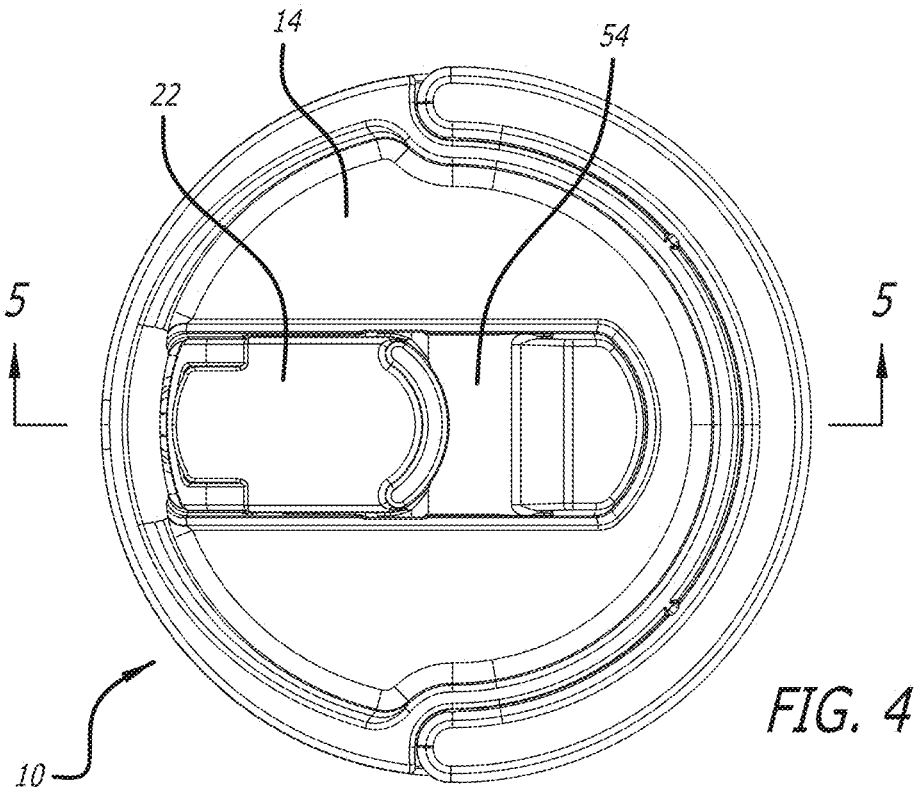
FIG. 4 is a top plan view of a lid with a lid seal mechanism in the closed position, according to the present disclosure.

Referring to FIGS. 1-3, 8 and 11, in one embodiment, the lid 14 has a top surface 53 with a cavity 54 with a bottom wall 56 and opposing sidewalls 58. The cavity 54 also has a first end 60 and a second end 62. As best shown in FIGS. 1 and 3, the cavity 54 has deeper portions at the first end 60 and second end 62 thereof. Additionally, the drink opening 12 is provided in the bottom wall 56 of the cavity 54 at the deeper portion toward the first end 60 of the cavity 54. The lid seal mechanism 10 generally resides in the cavity 54 of the lid 14.

In one embodiment, the sidewalls 58 each have an offset 64 for receiving the flanges 36 of the rear legs 34, and the flanges 38 of the front legs 32 of the slider 22. The offsets 64 in the sidewalls 58 operate as tracks for the flanges 36, 38 of the slider 22, thus the terms offset and tracks are used interchangeably, to allow the slider to slide within the tracks between an open position and a closed position. Each track/offset 64 has a first end 66 and a second end 68. In one embodiment, the first end 66 of the offsets 64 operates as stops for the flanges 38 of the front legs 32 of the slider 22 when the lid seal mechanism 10 is moved to the closed position as shown in FIGS. 1-5. Conversely, the second end 68 of the offsets 64 operates as stops for the flanges 36 of the rear legs 34 when the slider 22 is moved to the cleaning position.

As shown in FIGS. 1, 2, 5, 9 and 12, each offset 64 also has a larger offset portion 70 at the second end 68 of the offsets 64, as well as an exit opening 72 between the first end 66 and the second end 68. The exit opening 72 and larger offset portion 70, as well as the deeper portion of the cavity 54 at the second end 62 of the cavity 54 are designed to allow the slider 22 to be pivoted to the cleaning position as shown in FIGS. 11 and 12. Specifically, when the slider 22 is slid backward, the flanges 36 of the rear legs 34 of the slider 22 will reside within the larger offset portions 70 at the second end 64 of the offsets 64, and the flanges 38 of the front legs 32 will line up, respectively, with the exit openings 72 in the offsets 64. The user can pivot the slider 22 about the flanges 36 of the rear legs 34 by pushing down on the top surface 42 of the slider 22 adjacent the rear shoulder 44 of the slider 22. The front end 74 of the slider 22 where the plunger 20 is pivotally connected to will pivot up and out of the cavity 54 because the flanges 38 of the front legs 32 can exit the cavity 54 via the exit openings 72. Similarly, the second end 76 of the slider 22 will pivot into the deeper portion of the cavity 54 at the second end 62 of the cavity 54 to allow the slider 22 to pivot upwardly as shown in FIGS. 11 and 12 into the cleaning position. In this cleaning position both the drink opening 12 and the vent opening 28, as well as nearly the entire cavity 54 and the lid seal mechanism 10 are accessible for cleaning. When desired, the user can pivot the slider 22 about the rear flanges 36 of the rear legs 34 by pushing the front end 74 of the slider 22 back toward the cavity 54 to put the lid seal mechanism 10 back in the use orientation, moveable between the open and closed positions.

Figure 10:
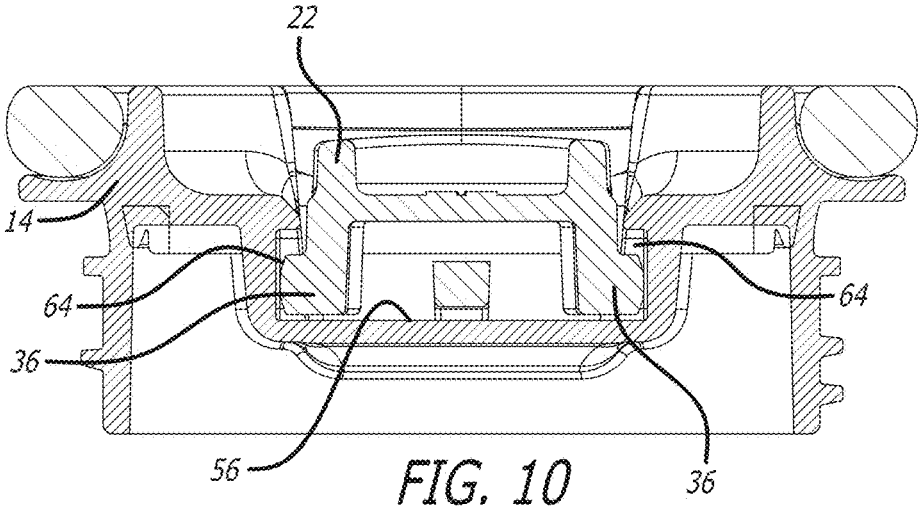
FIG. 10 is a cross-sectional view of the lid of FIG. 7, about line 10-10, according to the present disclosure.

In one embodiment, when the front and rear flanges 36, 38 are within the offsets 64 the slider 22 can slide within the offsets 64 (see FIG. 10) from the open position to the closed position, as well as the cleaning position. In the open positon of FIGS. 6-9, the lid seal mechanism 10 is slid back away from the first end 60 of the cavity 54 and the seal 18 on the plunger 20 is removed from the drink opening 12 and the drink opening 12 is therefore open, providing access to the cavity and contents within the beverage container 16 for the user to drink therefrom. To close the drink opening 12 and seal the contents of the beverage container 16 off from the outside, the user pushes the slider 22 toward the first end 60 of the cavity 54. As the slider 22 is moved toward the first end 60 of the cavity 54 the cam followers 48 that extend from the plunger 20 engage the bottom wall 56 of the cavity 54 of the lid 14. The bottom wall 56 has a cam surface 80 that engages the cam followers 48 of the plunger 20 to begin to pivot the plunger 20 from its first position (FIG. 8) to its second position (FIG. 5). When the slider 22 is fully in its closed position at the first end 60 of the cavity 54, the plunger 20 will have been pivoted to its second position (FIG. 5) aligned with the drink opening 12 and the seal 18 at the first end 50 of the plunger 20 will be closing off and sealing the drink opening 12. Further, in one embodiment as shown in FIG. 5, in this closed position of the lid seal mechanism 10, the axis of the seal 18 will preferably be aligned with the axis of the drink opening 12. Further, as shown in FIG. 5, in the closed position of the lid seal mechanism 10 the closure member 40 of the slider 22 will engage the vent grommet 29 to sealingly close off the vent opening 28.

In one embodiment, the lid 14 also has a handle 84 pivotally connected to the lid 14 with pivot pins 86.

The embodiments detailed hereinabove may be combined in full or in part, with any alternative embodiments described.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the present disclosure may be embodied in other specific forms without departing from the spirit or central characteristics thereof. The present examples and embodiments, therefore, are to be considered in all respects as illustrative and not restrictive, and the Claims are not to be limited to the details given herein. Accordingly, while the specific embodiments have been illustrated and described, numerous modifications come to mind without significantly departing from the spirit of the disclosure and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A lid seal mechanism for sealing a drink opening in a lid of a beverage container, comprising:

a slider having a body with a front and a rear, a front flange extending outwardly adjacent a front of the body, and a rear flange extending outwardly adjacent a rear of the body;

a plunger pivotally connected to the front of the slider with a plunger pin;

a plunger seal connected to a first end of the plunger, wherein the plunger pivots between a first position and a second position, in the first position the plunger is away from the drink opening, and in the second position the plunger is aligned with the drink opening such that the plunger seal can seal the drink opening; and, wherein the lid has a cavity with a first end and a second end, wherein the drink opening is in the cavity toward a first end thereof, wherein the cavity has tracks that receive the front flange and rear flange of the slider body to allow the slider to slide within the tracks between a closed position and an open position, and to a cleaning position, wherein the plunger is in the first position when the slider body is in the open position, and wherein the plunger is in the second position when the slider body is in the closed position.

2. The lid seal mechanism of claim 1, wherein the cavity has deeper portions at the first end and second end thereof.

3. The lid seal mechanism of claim 1, wherein the slider body has two front flanges and two rear flanges.

4. The lid seal mechanism of claim 3, wherein the rear flanges extend outwardly further than the front flanges.

5. The lid seal mechanism of claim 1, wherein the plunger has a cam follower that extends from the plunger toward the lid and which assists in pivoting the plunger toward the drink opening when the slider is pushed toward the drink opening of the lid by a user.

6. The lid seal mechanism of claim 5, wherein a bottom wall of the cavity has a cam surface that engages the cam follower of the plunger to pivot the plunger from its first position to its second position.

7. The lid seal mechanism of claim 1, wherein the cavity has an exit opening between the first end and the second end of the cavity to allow the front flange to exit out of the cavity when the slider is pivoted to the cleaning position.

8. The lid seal mechanism of claim 1, wherein the lid has a vent opening, and wherein the slider body has a closure member that closes the vent opening when the slider body is in the closed position.

9. The lid seal mechanism of claim 1, wherein the slider body is connected to the lid in the closed position, open position, and cleaning position.

10. The lid seal mechanism of claim 1, wherein upon sliding the slider body from the open position to the closed position a seal on the plunger automatically seals the drink opening in the lid, and wherein on sliding the slider body from the closed position to the open position the seal on the plunger automatically opens the drink opening in the lid so the user can drink contents within the beverage container.

11. A lid seal mechanism for sealing a drink opening in a lid of a beverage container, comprising:

a slider on a top surface of the lid, the slider body having a body with a front and a rear, a front flange extending outwardly adjacent a front of the body, and a rear flange extending outwardly adjacent a rear of the body;

a plunger pivotally connected to the front of the slider with a plunger pin; and, a plunger seal connected to a first end of the plunger, wherein the plunger slides with the slider and pivots between a first position and a second position, in the first position the plunger is away from the drink opening to allow a user to drink contents from the beverage container, and in the second position the plunger is aligned with the drink opening such that the plunger seal seals the drink opening.

12. The lid seal mechanism of claim 11, wherein the lid has a cavity with a first end and a second end, wherein the drink opening is in the cavity toward a first end thereof, wherein the cavity has tracks that receive the front flange and rear flange of the slider body to allow the slider to slide within the tracks between a closed position, an open position, and a cleaning position, wherein the plunger is in the first position when the slider body is in the open position, and wherein the plunger is in the second position when the slider body is in the closed position.

13. The lid seal mechanism of claim 12, wherein the cavity has an exit opening between the first end and the second end of the cavity to allow the front flange to exit out of the cavity when the slider is pivoted to the cleaning position.

14. The lid seal mechanism of claim 11, wherein the plunger has a cam follower that extends from the plunger toward the lid and which assists in pivoting the plunger toward the drink opening when the slider is pushed toward the drink opening of the lid by a user, wherein the lid has a cavity having a bottom wall, and wherein the bottom wall has a cam surface that engages the cam follower of the plunger to pivot the plunger from its first position to its second position.

15. A lid seal mechanism for sealing a drink opening in a lid of a beverage container, comprising:

a slider having a body with a front and a rear, the slider body sliding between a closed position and an open position, and pivoting to a cleaning position, the slider being connected to the lid in each of the closed position, open position, and cleaning position;

a plunger connected to the front of the slider;

a plunger seal connected to the plunger, the plunger seal sealing the drink opening in the lid when the slider is in the closed position, and the plunger seal opening the drink opening when the slider is in the open position; and, wherein the plunger and the plunger seal are above a top surface of the lid in a state in which the slider is in the cleaning position.

16. The lid seal mechanism of claim 15, wherein the slider is positioned adjacent the top surface of the lid.

17. The lid seal mechanism of claim 15, wherein the plunger has a first end and a second end, the second end of the plunger being pivotally connected to the front of the slider with a pin.

18. The lid seal mechanism of claim 16, wherein the plunger seal is connected to the first end of the plunger, wherein the plunger pivots between a first position and a second position, wherein upon sliding the slider body from the open position to the closed position the plunger seal seals the drink opening in the lid, wherein on sliding the slider body from the closed position to the open position the plunger seal opens the drink opening in the lid so the user can drink contents within the beverage container, and wherein upon moving the slider body to the cleaning position the slider body is pivoted away from the lid.

19. The lid seal mechanism of claim 15, wherein the lid has a cavity with a first end and a second end, wherein the drink opening is in the cavity toward a first end thereof, wherein the cavity has tracks that receive flanges extending from the slider body to allow the slider to slide within the tracks between the closed position and the open position.

20. The lid seal mechanism of claim 19, wherein the cavity has an exit opening between the first end and the second end of the cavity to allow the front flange to exit out of the cavity when the slider is pivoted to the cleaning position.

* * * * *